United States Patent [19]

Timmons

[11] Patent Number: 4,923,333

[45] Date of Patent: May 8, 1990

[54] LYSIMETER FOR LEAK DETECTION AND METHOD OF ASSEMBLY THEREOF

[76] Inventor: Robert D. Timmons, S 9061, Meadowdale Rd., Prairie Du Sac, Wis. 53578

[21] Appl. No.: 193,062

[22] Filed: May 12, 1988

[51] Int. Cl.[5] ..... E02D 3/00

[52] U.S. Cl. ..... 405/128; 405/52; 73/73; 73/863.23; 266/168; 210/323.2; 210/484

[58] Field of Search ..... 405/54, 128–129, 405/50; 73/73, 863.23, 864.43; 75/97, 101 R; 266/168, 170; 423/27, 98, 109; 210/484, 497 R, 232, 323.2

[56] References Cited

U.S. PATENT DOCUMENTS

| | | | |
|---|---|---|---|
| 2,768,949 | 10/1956 | Hewey | 210/6 |
| 3,425,555 | 2/1969 | Ridgeway | 210/65 |
| 3,591,580 | 7/1971 | Winterhalter et al. | 210/232 |
| 4,239,627 | 12/1980 | Wada | 210/484 |
| 4,352,601 | 10/1982 | Valiga et al. | 405/270 |
| 4,366,846 | 1/1983 | Curati, Jr. | 141/1 |
| 4,448,690 | 5/1984 | Maphis | 210/609 |
| 4,473,532 | 9/1984 | Rose et al. | 266/101 X |
| 4,526,615 | 7/1985 | Johnson | 75/101 R |
| 4,543,013 | 9/1985 | Wagner et al. | 405/128 |
| 4,609,465 | 9/1986 | Miller | 210/323.2 |
| 4,739,973 | 4/1988 | Herndon | 266/101 |
| 4,759,227 | 7/1988 | Timmons | 73/863.23 |

OTHER PUBLICATIONS

Robert D. Morrison, Ground Water Monitoring Technology, 1983, pp. 44–55.

*Primary Examiner*—Dennis L. Taylor
*Assistant Examiner*—Franco S. DeLiguori
*Attorney, Agent, or Firm*—Shlesinger & Myers

[57] ABSTRACT

A lysimeter comprises a longitudinally extending circumferentially perforated duct having a vacuum application connection at one end thereof. A fluid permeable fabric is superposed over the duct perforations. A longitudinally extending circumferentially perforated shell extends about the duct and therewith defines a bounded volume therebetween. A granular filler substantially fills the bounded volume and the filler is sized so not to be drawn through the fluid permeable fabric so that a vacuum applied to the duct is transmitted through the shell.

A ground protection system for a heap leaching site incorporating the lysimeter of the present invention is also disclosed as well as a method of assembling the lysimeter.

27 Claims, 2 Drawing Sheets

FIG. 3
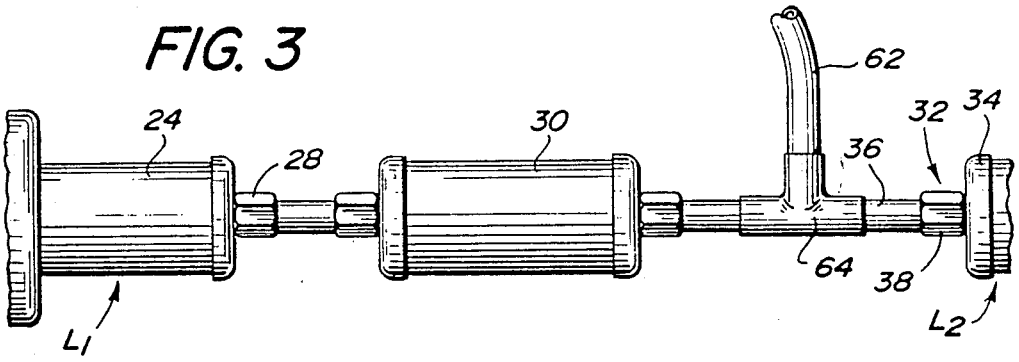
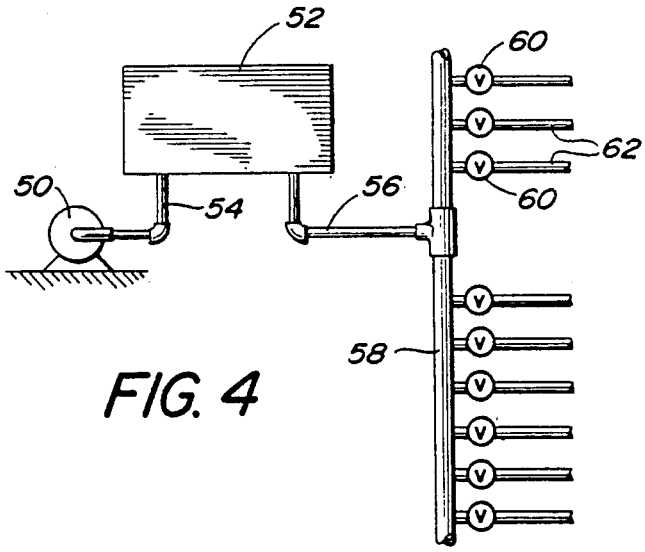
FIG. 4
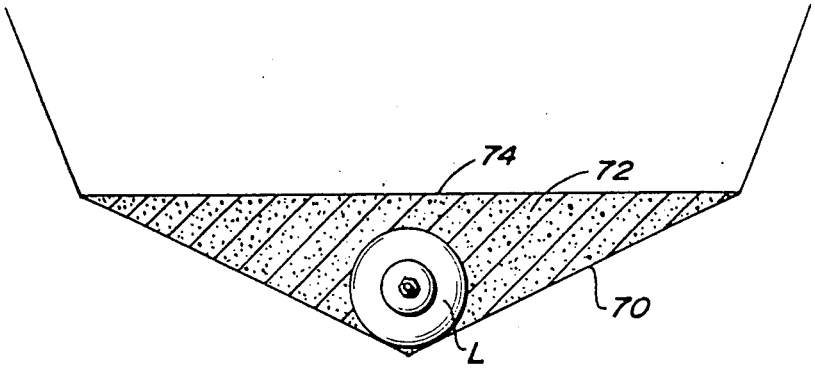
FIG. 5

LYSIMETER FOR LEAK DETECTION AND METHOD OF ASSEMBLY THEREOF

BACKGROUND OF THE INVENTION

A lysimeter is a hydrologic measuring instrument used to monitor the transmission rate and/or presence of fluid in soil or like substrates. The lysimeter accomplishes this function by application of vacuum principles causing the fluid to be drawn toward the lysimeter. Removal of collected fluid from the lysimeter may be by any one of a number of methods.

Heap leaching is a process used to recover materials from ore and the like. Typically, a trench is dug into the ground and the sides thereof are lined with an impermeable barrier. The ore to be treated is placed into the trench, as are appropriate solubilizing chemicals. The solubilizing chemicals, typically, are toxic, and leakage thereof into the earth is to be avoided. An exemplary disclosure of a heap leaching system is found in Johnson, U.S. Pat. No. 4,526,615 for CELLULAR HEAP LEACH PROCESS AND APPARATUS, which patent discloses the use of a perforated pipe to collect leach solution draining from the impermeable barrier.

Detection of the leakage of toxic chemicals from the heap leach pad is important if such processes are not to cause environmental damage. the heap leach pad can cover a rather large area, and it is necessary that a leak be detected relatively quickly in order to avoid damage to surrounding soil. It is furthermore important that the location of a leak be determined with relative accuracy in order to permit suitable repairs to be made with a minimum amount of disruption to the overall leaching system.

Naturally occurring soil is subject to numerous inconsistencies caused by discontinuities in the soil. Further inconsistencies are caused by rocks, other foreign matter and the like. Such inconsistencies can give rise to channeling of whatever fluids may be percolating through the substrate, thereby giving rise to errors in site location should leak detection be attempted.

The disclosed invention is a lysimeter specifically directed towards use with a heap leaching system in order to permit accurate detection and location of leach pad leaks. The lysimeter causes a vacuum to be applied to a prepared granular substrate which avoids channeling, filters particulates to prevent clogging of the lysimeter and provides a uniform medium for vacuum transmission. The lysimeter of the invention is relatively inexpensive to manufacture, may be interconnected into a series of lysimeter strings extending the length of each leach pad, and the individual lysimeters can be selectively addressed in order to permit the site of a leak to be accurately and quickly identified.

OBJECTS AND SUMMARY OF THE INVENTION

The primary object of the disclosed invention is a lysimeter and method of its assembly, utilized in a heap leaching system to permit solution leaks to be quickly detected and located.

A lysimeter according to the invention comprises a longitudinally extending circumferentially perforated duct having vacuum application means at one end thereof. A fluid permeable means is superposed over the duct perforations. A longitudinally extending circumferentially perforated shell extends about at least a portion of the duct and therewith defines a bounded volume therebetween. A granular filler substantially fills the bounded volume and the filler is sized so as not to be drawn through the fluid permeable means when the vacuum is applied to the duct means, which vacuum is transmitted through the shell into the surrounding substrate.

A ground water protection system for a heap leaching site comprises at least a first trench disposed in a substrate. A first chemically inert impermeable barrier is positioned in the trench for preventing migration of fluid to the substrate. At least a first lysimeter is positioned in the trench above the barrier and comprises a longitudinally extending circumferentially perforated duct having vacuum application means at one end thereof. Fluid permeable means are superposed over the duct perforations and a longitudinally extending circumferentially perforated shell extends about the duct and therewith defines therebetween a bounded volume. First granular filler means substantially fills the bounded volume and are sized so as not to be drawn through the fluid permeable means when a vacuum is applied to the duct. A supply of second granular filler means is disposed about the shell. A second chemically inert barrier is disposed over the second granular filler means and exposed portions of the first barrier for therewith defining a heap leach site. A vacuum pump is connected to the vacuum application means for applying a vacuum to the duct so that fluid penetrating the second barrier from the site is caused to be drawn to the lysimeter and to thereby be detected.

The method of assembling a lysimeter according to the invention comprises the steps of providing a generally cylindrical duct having a plurality of axially spaced slots therein. Superposed about the slots is a fluid permeable means. A shell having a plurality of axially spaced second slots is positioned about the duct and is spaced therefrom for therewith defining therebetween a bounded volume. A first end of the bounded volume is closed. The bounded volume is filled through a second end thereof with a granular filler having a size sufficiently large to prevent the filler from being drawn through the fluid permeable means when a vacuum is applied to the duct. The second end is then closed.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 3 is a plan view illustrating the interconnection of a plurality of the lysimeters of FIG. 2;

FIG. 4 is a fragmentary schematic view disclosing the header system used for selectively addressing the lysimeters of FIG. 3;

FIG. 5 is an end view partially in section disclosing a heap leach site pursuant to the invention; and, FIG. 6 is a view similar to that of FIG. 1 illustrating use of the invention with plural heap leach sites.

DESCRIPTION OF THE INVENTION

Figure 2:
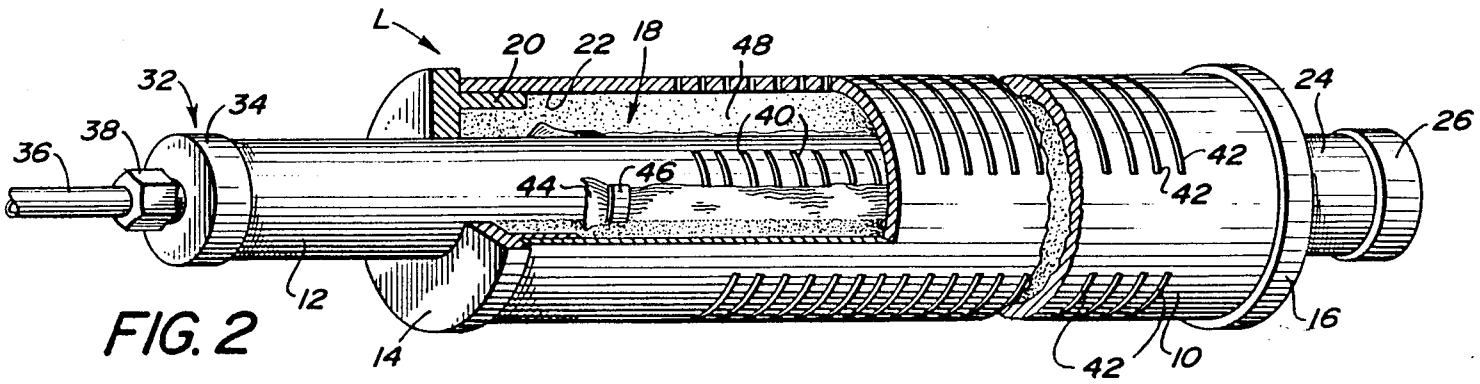
FIG. 2 is a fragmentary perspective view partially in section disclosing the lysimeter of the invention.

Lysimeter L, as best shown in FIG. 2, has a generally cylindrical exterior shell 10 in which a central cylindrical duct 12 is positioned. Flanges 14 and 16 extend orthogonal to the axis of duct 12 and seal the duct 12 to the shell 10 and therewith define a bounded volume 18 extending therebetween. FIG. 2 discloses lip 20 extending axially from the flange 14 toward flange 16 for providing a good seal with the interior surface 22 of shell 10. A similar lip extends from the flange 16 for like reasons.

The duct 12 extends beyond flange 16 by means of extension 24. The extension 24 may be closed by cap 26, as best shown in FIG. 2, or may have an outlet assembly 28 permitting communication with check valve 30, as best shown in FIG. 3. The check valve 30 isolates the lysimeter L1 from lysimeter L2 of FIG. 3 and therefore allows interconnection of plural lysimeters L into rows. In this way, vacuum applied to lysimeter L2 will not be applied to lysimeter L1, thereby permitting accurate leak detection.

The inlet assembly 32 of FIG. 2 includes an apertured cap 34 to which vacuum line 36 is connected through coupling 38. The vacuum line 36 permits a vacuum to be applied to the interior of duct 12 so that the vacuum may be transferred through slots 40 in duct 12 into bounded space 18. The slots 40 are axially disposed on uniformly spaced apart parallel planes. The slots 40 are disposed in cooperating slot pairs, each on one side of duct 12. Each slot 40 subtends a common portion of the circumference of the cylindrical duct 12.

The duct 12 is, preferably, comprised of a chemically inert synthetic material such as polyvinyl chloride. Similarly, the vacuum line 36, coupling 38 and cap 34 are likewise formed of chemically inert material in order to withstand attach by the toxic leach solution.

Similar slots 42 are formed in the shell 10. Each slot 42 of a slot pair subtends a uniform portion of the circumference of the shell 10. The slots 42 are disposed on uniformly spaced apart parallel planes which are, preferably, aligned with the planes on which the slots 40 are formed and the slots of the slot pairs are disposed on opposite sides of shell 10. In this way, each slot 40 is aligned with one of the slots 42, although the slots 40 are angularly offset from the slots 42.

A fluid permeable woven synthetic fabric 44 is disposed about the duct 12 and is superposed about the slots 40. The fabric 44 is secured by means of a synthetic chemically inert tie 46 to the duct 12. At least one tie 46 is provided at each end of the fabric 44, and each tie 46 is axially spaced from the last one of the associated slots 40.

The fabric 44 is, preferably, a knitted polyester fabric which has a water flow rate in the range of 225 gallons per minute per square foot. Preferably, the fabric 44 has a water permeability of 0.1 cm per second, with an equivalent opening of 90 standard sieve.

The bounded volume 18 is, preferably, filled with a sized chemically inert granular material, such as silica flour. I have found it important to control the size distribution of the silica flour 48 because relatively large particles permit air entry into the bounded volume 18, and air entry is detrimental. Silica flour of 200 mesh or finer provides appropriate performance, and the mesh may be as fine as 325 in certain applications. The silica flour 48 fills the bounded volume 18 in order to assure good vacuum transmission from the duct 12 to the media surrounding the lysimeter L.

FIG. 4 discloses vacuum pump 50 communicating with reservoir 52 through line 54. A similar line 56 extends from reservoir 52 to header 58. Valves 60 extend from header 58 and each valve 60 communicates through a line 62 with a connection 64 in operable connection with check valve 30 and inlet assembly 32. In this way, appropriate selection of a valve 60 permits the vacuum exerted by the pump 50 to be applied to a selected one of the lysimeters L. The check valve 30 prevents the vacuum from being applied to the lysimeter L1 of FIG. 3 while permitting the vacuum to be applied to the lysimeter L2 of FIG. 3. In this way, it is possible to individually address the lysimeters L of a string and therefore determine which lysimeter L is detecting fluid when the vacuum is applied. The location of the individual lysimeter L is known, therefore permitting accurate location of the leak.

Figure 1:
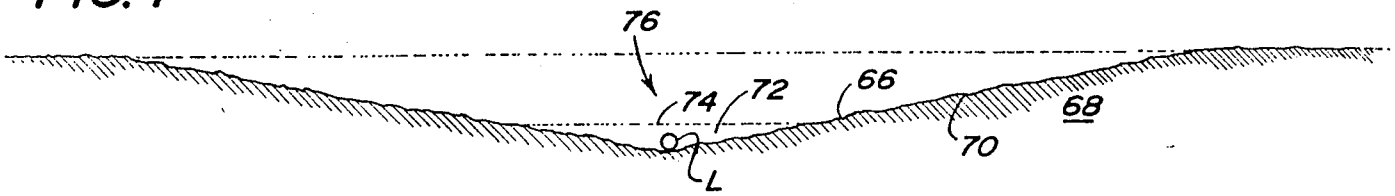
FIG. 1 is a cross-sectional view of a heap leach site pursuant to the invention.

FIG. 1 is a schematic view illustrating a heap leach system incorporating plural lysimeters L. A trench 66 is formed in the substrate 68 by conventional means. A first impermeable plastic liner 70, comprised of polyvinyl chloride or the like, is placed over the exposed portions of the trench 66. A string of lysimeters L is then placed over the barrier 70, preferably at the valley of the trench 66. A supply of silica flour 72 is then placed over the liner 70 and about the string of lysimeters L. The flour 72 preferably is of the same size distribution and composition as is the flour 48 in the lysimeters L. The flour 72 is packed so as to have a density substantially the same as the density of the flour 48 filling the lysimeters L. Also, use of flour 72, which is cleaned, prevents lysimeter L from becoming clogged with diverse particulates. This extends the operational life of the lysimeters. A second impermeable liner 74, preferably comprised of the same material as is the liner 70, is then positioned over the flour 72 and the exposed portions of the liner 70 in order to define a leach pad 76. The leach pad 76 may then be filled with the ore and solubilizing solution.

FIG. 5 discloses that the trench and the liner 70 are preferably of triangular configuration in cross-section in order to cause fluid to be drawn more easily toward the lysimeters L. I have also found it important to level the surface of the silica flour 72 so that the liner 74 is relatively flat along the bottom thereof for maximizing the volume of the leach pad 76.

Figure 6:
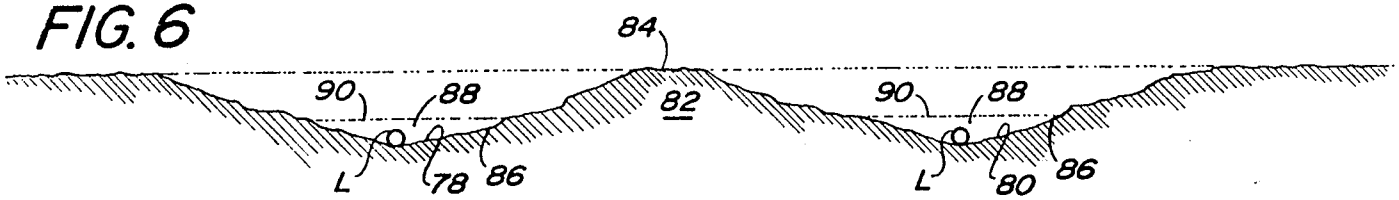

FIG. 6 discloses plural parallel trenches 78 and 80 formed in strata 82. It can be noted that a berm 84 separates the trenches 78 and 80 in order to permit one of the trenches to be worked on while the other is in use. Each of the trenches 78 and 80 has a string of the lysimeters L overlying an impermeable layer 86. Similarly, silica flour 88 surrounds the strings of lysimeters L and the second impermeable layer 90 overlies the flour 88 in order to define the leach pad.

I have found it important to utilize essentially identical silica flour 48 and 72 or 48 and 88 in use of the lysimeter L at a heap leach facility. The commonly sized silica flour ensures proper contact of the surrounding soil with the lysimeter L. This provides good continuity between the porous media and the surrounding soil. If poor contact is made with the surrounding soil, then the vacuum will be broken and sample collection will be impeded. For this reason, coarse silica flour is not utilized. Also, common silica flour permits good vacuum transmission through the width of trenches 66, 78 and 80.

Assembly of the lysimeter L of FIG. 2 is relatively straightforward. Initially, the slots 40 are cut into the already sized duct 12. The fabric 44 is then secured to the duct 12 through use of the plastic ties 46. The flange 16 is secured to the shell 10 and the duct 12, preferably by gluing or the like. The bounded volume 18 is then filled with the silica flour 48 and the flange 14 positioned and secured to the shell 10 and the duct 12.

I have found that it is important for the silica flour to be added to the bounded volume 18 in a manner which assures proper consistency and packing. For this reason, I first blend the silicon flour to the proper consistency in a blending tank through use of proper additions of water. It is important that the water used be deionized in order to prevent carry over of contaminants. Once the silica flour/water mix has attained the proper consistency, then it may be transferred to the bounded volume 18 through use of a pump.

As previously noted, the slots 40 are angularly offset from the slots 48. This assures that the applied vacuum is transmitted through the silica flour 48, and avoids channeling as could occur should one slot be superposed over another. The silica flour 48 distributes the vacuum throughout the bounded volume 18 and thereby assures proper transmission of the vacuum to the slots 42.

While this invention has been described as having a preferred design, it is understood that it is capable of further modifications, uses and/or adaptations of the invention following in general the principle of the invention, and including such departures from the present disclosure as come within known or customary practice in the art to which the invention pertains, and as may be applied to the central features hereinbefore set forth, and fall within the scope of the invention of the limits of the appended claims.

What I claim is:

1. A lysimeter, comprising:
(a) a longitudinally extending circumferentially perforated duct means having vacuum application means at one end thereof;
(b) fluid permeable means superposed over the duct means perforations;
(c) a longitudinally extending circumferentially perforated shell extending about at least a portion of said duct means and therewith defining a bounded volume therebetween; and,
(d) granular filler means substantially filling said bounded volume and said filler means sized so not to be drawn through said fluid permeable means when a vacuum is applied to said duct means.

2. The lysimeter of claim 1, wherein:
(a) said duct means perforations are uniformly axially spaced; and,
(b) said shell perforations are uniformly axially spaced.

3. The lysimeter of claim 2, wherein:
(a) each duct means perforation extends over a portion of the circumference thereof; and,
(b) each shell perforation extends over a portion of the circumference thereof.

4. The lysimeter of claim 3, wherein:
(a) each duct means perforation is angularly offset from an associated shell perforation.

5. The lysimeter of claim 1, wherein:
(a) said filler means is no larger than 200 mesh.

6. The lysimeter of claim 5, wherein:
(a) said filler means is silica flour.

7. The lysimeter of claim 1, wherein:
(a) said fluid permeable means is a woven fabric.

8. The lysimeter of claim 7, wherein:
(a) said fabric extends about said duct means; and,
(b) means secure opposite end portions of said fabric to said duct means.

9. The lysimeter of claim 5, wherein:
(a) said fluid permeable means is a woven synthetic fabric.

10. The lysimeter of claim 1, wherein:
(a) said duct means and said shell are comprised of a synthetic chemically inert material.

11. A lysimeter, comprising:
(a) a generally cylindrical duct having a plurality of axially spaced first slots and a vacuum application means at one end thereof;
(b) a chemically inert mesh secured exteriorly of said duct and overlying said slots;
(c) a generally cylindrical shell having a plurality of axially spaced second slots, said shell disposed about said duct and spaced therefrom for therewith defining therebetween a bounded volume;
(d) seal means secured to opposite ends of said shell and to said duct for sealing said bounded volume; and,
(e) granular filler means substantially filling said bounded volume and being sized so not to be drawn through said mesh when a vacuum is applied to said duct.

12. The lysimeter of claim 11, wherein:
(a) said mesh is a woven synthetic fabric.

13. The lysimeter of claim 11, wherein:
(a) said filler means has a size not exceeding 200 mesh.

14. The lysimeter of claim 11, wherein:
(a) said first slots are disposed in a plurality of slot pairs, each slot of a slot pair subtending a portion of said duct circumference and formed on a plane common to the associated slot.

15. The lysimeter of claim 14, wherein:
(a) said first slots subtending substantially uniform portion of said duct circumference; and,
(b) said first slots are uniformly spaced apart.

16. The lysimeter of claim 14, wherein:
(a) said second slots are disposed in a plurality of second slot pairs, each slot of a second slot pair subtends a portion of said shell circumference and is formed on a plane common to the associated second slot.

17. The lysimeter of claim 16, wherein:
(a) each second slot is angularly offset from an associated first slot.

18. The lysimeter of claim 11, wherein:
(a) said duct and said shell are disposed on a common axis; and,
(b) said seal means extend on spaced parallel planes disposed generally orthogonal to said common axis.

19. A ground water protection system for a heap leach site, comprising:
(a) at least a first trench disposed in a substrate;
(b) a first chemically inert impermeable barrier disposed in said trench for preventing migration of fluid to said substrate;
(c) a lysimeter positioned in said trench above said barrier and said lysimeter comprising a longitudinally extending circumferentially perforated duct having vacuum application means at one end thereof, fluid permeable means superposed over said duct perforations, a longitudinally extending circumferentially perforated shell extending about said duct and therewith defining therebetween a bounded volume, and first granular filler means substantially filling said bounded volume and being sized so not to be drawn through said fluid permeable means when a vacuum is applied to said duct;

(d) a supply of second granular filler means disposed about said shell;

(e) a second chemically inert barrier disposed over said second granular filler means and exposed portions of said first barrier for therewith defining a heap leach site; and, (f) vacuum means connected to said vacuum application means for applying a vacuum to said duct so that fluid penetrating said second barrier is caused to be drawn to said lysimeter and for thereby being detected.

20. The system of claim 19, wherein:

(a) a plurality of said lysimeters are positioned in said trench in spaced relation; and, (b) valve means operably interconnect each vacuum application means with said vacuum means so that a vacuum may be applied to a selected one of said lysimeters.

21. The system of claim 19, wherein:

(a) said first and second granular filler means each not exceeding 200 mesh in size and each being chemically inert.

22. The system of claim 21, wherein:

(a) said first and second granular filler means each being silica flour and of a common size.

23. The system of claim 19, wherein:

(a) said first and second barriers comprised of a synthetic polymer; and, (b) said duct and said shell comprised of a chemically inert synthetic polymer.

24. The system of claim 20, wherein:

(a) check valve means are disposed between each of said lysimeters for preventing application of the vacuum to other than the selected one of said lysimeters.

25. A method of assembling a lysimeter, comprising the steps of:

(a) providing a generally cylindrical duct having a plurality of axially spaced slots therein;

(b) superposing about the slots a fluid permeable means;

(c) positioning a shell having a plurality of axially spaced second slots about the duct and spaced therefrom for therewith defining therebetween a bounded volume;

(d) closing a first end of said bounded volume;

(e) filling said bounded volume through a second end thereof with a granular filler having a size sufficiently large to prevent the filler from being drawn through the fluid permeable means when a vacuum is applied to the duct; and, (f) closing the second end.

26. The method of claim 25, including the step of:

(a) filling the bounded volume with a granular filler having a size not exceeding 200 mesh.

27. The method of claim 25, including the step of:

(a) providing a synthetic woven fabric as the fluid permeable means; and, (b) securing the fabric to the duct.

* * * * *